US011335265B2

(12) United States Patent
Gao et al.

(10) Patent No.: US 11,335,265 B2
(45) Date of Patent: May 17, 2022

(54) PIXEL CIRCUIT, DRIVING METHOD THEREOF, AND DISPLAY APPARATUS

(71) Applicant: BOE TECHNOLOGY GROUP CO., LTD., Beijing (CN)

(72) Inventors: Xueling Gao, Beijing (CN); Kuanjun Peng, Beijing (CN); Wei Qin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 160 days.

(21) Appl. No.: 16/638,898

(22) PCT Filed: Mar. 13, 2019

(86) PCT No.: PCT/CN2019/077995
§ 371 (c)(1),
(2) Date: Feb. 13, 2020

(87) PCT Pub. No.: WO2020/181526
PCT Pub. Date: Sep. 17, 2020

(65) Prior Publication Data

US 2021/0217363 A1 Jul. 15, 2021

(51) Int. Cl.
*G09G 3/3258* (2016.01)
*G09G 3/20* (2006.01)
*G09G 3/3291* (2016.01)

(52) U.S. Cl.
CPC ..... *G09G 3/3258* (2013.01); *G09G 3/2092* (2013.01); *G09G 3/3291* (2013.01);
(Continued)

(58) Field of Classification Search
CPC ... G09G 2320/0233; G09G 2320/0209; G09G 2320/0223; G09G 3/3233; G09G 3/30;
(Continued)

(56) References Cited

U.S. PATENT DOCUMENTS 9,721,508 B2 8/2017 Sun et al.
9,842,539 B2 * 12/2017 Hung ..... G09G 3/3233
(Continued)

FOREIGN PATENT DOCUMENTS

CN 102903333 A 1/2013
CN 103035195 A 4/2013
(Continued)

OTHER PUBLICATIONS

International Search Report dated Dec. 11, 2019, issued in counterpart application No. PCT/JP2019/077995 (10 pages).

*Primary Examiner* — Dong Hui Liang
(74) *Attorney, Agent, or Firm* — WHDA, LLP

(57) ABSTRACT

The present disclosure relates to a pixel circuit. The pixel circuit may include a storage capacitor, an initialization sub-circuit and a light-emitting control sub-circuit. The initialization sub-circuit is configured to store an initial voltage of the initial voltage terminal in the first terminal of the storage capacitor under a control of a light-emitting control signal of the light-emitting control terminal; and the light-emitting control sub-circuit is configured to apply a first voltage of the first voltage terminal to the first terminal of the storage capacitor. The first voltage terminal and the initial voltage terminal are separated terminals.

15 Claims, 5 Drawing Sheets

(52) U.S. Cl.
CPC ..... *G09G 2300/0426* (2013.01); *G09G 2310/061* (2013.01)

(58) Field of Classification Search
CPC .. G09G 3/3283; G09G 3/3291; G09G 3/3275; G09G 2230/00; G09G 2300/0426; G09G 2300/043; G09G 2300/0819; G09G 2300/0866; G09G 2300/0871; G09G 2310/0251; G09G 2310/06
See application file for complete search history.

(56) References Cited

U.S. PATENT DOCUMENTS

| | | | | |
|---|---|---|---|---|
| 10,032,412 | B2 | 7/2018 | Zhu et al. | |
| 2008/0309595 | A1* | 12/2008 | Nitomi | G09G 3/3291 345/76 |
| 2010/0090993 | A1* | 4/2010 | Tseng | G09G 3/3233 345/204 |
| 2012/0050344 | A1 | 3/2012 | Kim et al. | |
| 2013/0088474 | A1 | 4/2013 | Wang et al. | |
| 2014/0014912 | A1* | 1/2014 | Kim | H01L 51/50 257/40 |
| 2015/0294622 | A1* | 10/2015 | Chaji | G09G 3/3291 345/80 |
| 2017/0330512 | A1* | 11/2017 | Zhou | G09G 3/325 |
| 2018/0182346 | A1* | 6/2018 | Ryu | G09G 3/3688 |
| 2019/0287462 | A1 | 9/2019 | Zhou | |

FOREIGN PATENT DOCUMENTS

| | | | |
|---|---|---|---|
| CN | 105225626 | A | 1/2016 |
| CN | 105405397 | A | 3/2016 |
| CN | 207474028 | U | 6/2018 |
| CN | 108492780 | A | 9/2018 |
| CN | 108735155 | A | 11/2018 |
| CN | 109147676 | A | 1/2019 |

* cited by examiner

PIXEL CIRCUIT, DRIVING METHOD THEREOF, AND DISPLAY APPARATUS

TECHNICAL FIELD

The present disclosure relates to a field of display technology, and particularly, to a pixel circuit, a driving method thereof and a display apparatus.

BACKGROUND

In an active matrix organic electroluminescent display device, a power supply voltage is provided to a driving transistor to drive an organic light-emitting diode (OLED) to emit light. Usually, lines for applying the power supply voltage are arranged in columns, and made of metal. During a frame, current flows through the power supply voltage lines and the OLED. But the power supply voltage drops due to the lengthy distance of transmission. Thus, the display quality of the display apparatus is prone to be decreased.

BRIEF SUMMARY

In one aspect, the present disclosure provides a pixel circuit. The pixel circuit may include a storage capacitor, an initialization sub-circuit and a light-emitting control sub-circuit. The storage capacitor includes a first terminal and a second terminal. The initialization sub-circuit includes an initial voltage terminal, the initialization stub-circuit being coupled to the first terminal of the storage capacitor and a light-emitting control terminal. The light-emitting control sub-circuit includes a first voltage terminal, the light-emitting control sub-circuit being coupled to the first terminal of the storage capacitor and the light-emitting control terminal. The initialization sub-circuit is configured to store an initial voltage of the initial voltage terminal in the first terminal of the storage capacitor under a control of a light-emitting control signal of the light-emitting control terminal; and the light-emitting control sub-circuit is configured to apply a first voltage of the first voltage terminal to the first terminal of the storage capacitor. The first voltage terminal and the initial voltage terminal are separated terminals.

In some embodiments, the initialization sub-circuit includes a first transistor, and a gate of the first transistor is coupled to the light-emitting control terminal. A first electrode of the first transistor is coupled to the initial voltage terminal; and a second electrode first transistor is coupled to the tint terminal of the storage capacitor.

In some embodiments, the light-emitting control sub-circuit includes a fifth transistor and a sixth transistor. A gate of the fifth transistor and a gate of the sixth transistor are respectively coupled to the light-emitting control terminal. A first electrode of the fifth transistor and a first electrode of the sixth transistor are respectively coupled to the first voltage terminal. And a second electrode of the fifth transistor is coupled to the first terminal of the storage capacitor.

In some embodiments, the first transistor is one of P-type transistor and N-type transistor, and the fifth transistor and the sixth transistor are the other one of P-type transistor and N-type transistor.

In some embodiments, the pixel circuit further includes a reset sub-circuit. The reset sub-circuit includes a second transistor, a reference voltage terminal and a first gate signal terminal. A gate of the second transistor is coupled to the first gate signal terminal. A first electrode of the second transistor is coupled to the reference voltage terminal. A second electrode of the second transistor is coupled to the second terminal of the storage capacitor. And the reset sub-circuit is configured to reset an electric potential of the second terminal of the storage capacitor.

In some embodiments, the pixel circuit further includes a driving transistor. The gate of the driving transistor is coupled to the second terminal of the storage capacitor. A second electrode of the driving transistor is coupled to a second electrode of the sixth transistor. And the driving transistor is configured to drive a light-emitting element.

In some embodiments, the pixel circuit further includes an input sub-circuit including a fourth transistor, a second gate signal terminal and a data voltage terminal. A gate of the fourth transistor is coupled to the second gate signal terminal. A first electrode of the fourth transistor is coupled to the data voltage terminal. A second electrode of the fourth transistor is coupled to the second electrode of the driving transistor. And the input sub-circuit is configured to apply a data voltage to the second electrode of the driving transistor under a control of a second gate signal in the second gate signal terminal.

In some embodiments, the pixel circuit further includes a compensation sub-circuit including a third transistor. A gate of the third transistor is coupled to the second gate signal terminal. A first electrode of the third transistor is coupled to the second terminal of the storage capacitor. A second electrode of the third transistor is coupled to a first electrode of the driving transistor. And the compensation sub-circuit is configured to compensate a threshold voltage of the driving transistor.

In some embodiments, the pixel circuit further includes a switch transistor. A gate of the switch transistor is coupled to the light-emitting control terminal. A first electrode of the switch transistor is coupled to the first electrode of the driving transistor. A second electrode of the switch transistor is coupled to a first terminal of the light-emitting element. The switch transistor is configured to control the connection between the driving transistor and the light-emitting element.

In some embodiments, the light-emitting element is an organic light-emitting diode, and a second terminal of the light-emitting element is coupled to a second voltage terminal.

In some embodiments, the first transistor and the driving transistor are P-type transistors. The second transistor, the third transistor, the fourth transistor, the fifth transistor, the sixth transistor and the switch transistor are N-type transistors.

In some embodiments, the first transistor and the driving transistor are N-type transistors. The second transistor, the third transistor, the fourth transistor, the fifth transistor, the sixth transistor and the switch transistor are P-type transistors.

In another aspect, the present disclosure provides a display apparatus. The display apparatus includes a plurality of sub-pixels and the light-emitting element. Each of the plurality of sub-pixels comprises the pixel circuit described herein.

In another aspect the present disclosure provides a driving method for a pixel circuit described herein. The driving method includes storing an initial voltage to a first terminal of the storage capacitor; resetting an electric potential of a second terminal of the storage capacitor to be equal to a reference voltage; inputting a data voltage to a second electrode of the driving transistor; compensating the electric potential of the second terminal of the storage capacitor, by charging the storage capacitor until the electric potential of the second terminal of the storage capacitor being equal to a sum of the data voltage and a threshold voltage of the driving transistor; and controlling a light-emitting element to emit light.

In some embodiments, the storing the initial voltage to the first terminal of the storage capacitor includes turning on the first transistor so that an electric potential of the first terminal of the storage capacitor is equal to the initial voltage.

In some embodiments, the resetting the electric potential of the second terminal of the storage capacitor to be equal to a reference voltage includes turning on the second transistor so that the electric potential of the second terminal of the storage capacitor is equal to the reference voltage.

In some embodiments, the inputting the data voltage to the second electrode of the driving transistor and compensating the electric potential of the second terminal of the storage capacitor include turning on the first transistor, the third transistor, the fourth transistor and the driving transistor, so that the electric potential of the second terminal of the storage capacitor is equal to a sum of the data voltage and a threshold voltage of the driving transistor.

In some embodiments, the controlling the light-emitting element to emit light includes turning on the fifth transistor, the sixth transistor, the driving transistor and the switch transistor, so that the electric potential of the first terminal of the storage capacitor is equal to a first voltage, the electric potential of the second terminal of the storage capacitor is equal to a sum of the data voltage, a threshold voltage of the driving transistor and a result of the first voltage minus the initial voltage.

BRIEF DESCRIPTION OF THE DRAWINGS

The subject matter which is regarded as the disclosure is particularly pointed out and distinctly claimed in the claims at the conclusion of the specification. The foregoing and other objects, features, and advantages of the present disclosure are apparent from the following detailed description taken in conjunction with the accompanying drawings in which:

DETAILED DESCRIPTION

Figure 1:
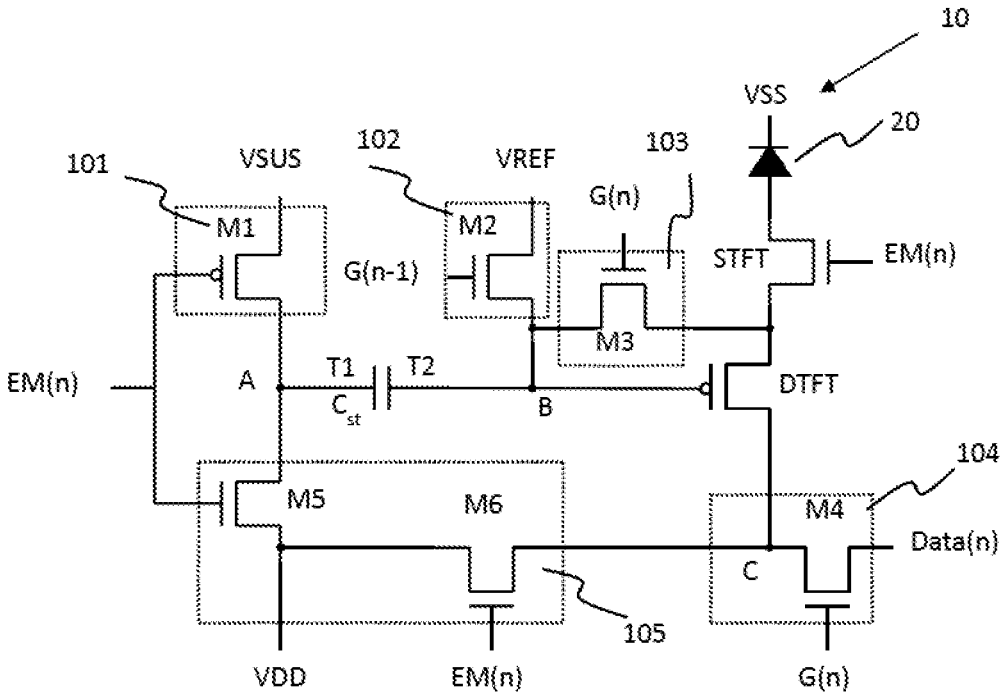
FIG. 1 is a schematic structural diagram of a pixel circuit according to one embodiment of the present disclosure.

The present disclosure will be described in further detail with reference to the accompanying drawings and embodiments in order to provide a better understanding by those skilled in the art of the technical solutions of the present disclosure. Throughout the description of the disclosure, reference is made to FIGS. 1-5. When referring to the figures, like structures and elements shown throughout are indicated with like reference numerals.

One embodiment of the present disclosure provides a pixel circuit. FIG. 1 is a schematic, structural diagram of a pixel circuit according to one embodiment of the present disclosure. As shown in FIG. 1, the pixel circuit 10 may include a storage capacitor $C_{st}$ an initialization sub-circuit 101 and a light-emitting, control sub-circuit 105. The storage capacitor $C_{st}$ includes a first terminal T1 and a second terminal T2. The initialization sub-circuit 101 includes an initial voltage terminal VSUS. The initialization sub-circuit 101 is coupled to the first terminal T1 of the storage capacitor $C_{st}$ and a light-emitting control terminal EM(n). The light-emitting control sub-circuit 105 includes a first voltage terminal VDD. The light-emitting control sub-circuit 105 is coupled to the first terminal T1 of the storage capacitor $C_{st}$ and the light-emitting control terminal EM(n). The initialization sub-circuit 101 is configured to store an initial voltage Vsus of the initial voltage terminal VSUS in the first terminal T1 of the storage capacitor $C_{st}$ under a control of a light-emitting control signal of the light-emitting control terminal EM(n). The light-emitting control sub-circuit 105 is configured to apply a first voltage Vdd of the first voltage terminal VDD to the first terminal T1 of the storage capacitor $C_{st}$. The first voltage terminal VDD and the initial voltage terminal VSUS are two separated terminals.

In some embodiments, as shown in FIG. 1, the initialization sub-circuit 101 includes a first transistor M1. A gate of the first transistor M1 is coupled to the light-emitting control terminal EM(n). A first electrode of the first transistor M1 is coupled to the initial voltage terminal VSUS. A second electrode of the first transistor M1 is coupled to the first terminal T1 of the storage capacitor $C_{st}$, at the first node A.

In some embodiments, the pixel circuit 10 further includes a reset sub-circuit 102. In one embodiment, as shown in FIG. 1, the reset sub-circuit 102 includes a second transistor M2. A gate of the second transistor M2 is coupled to a first gate signal terminal C(n-1). A first electrode of the second transistor M2 is coupled to the reference voltage terminal VREF. A second electrode of the second transistor M2 is coupled to the second terminal T2 of the storage capacitor $C_{st}$ at the second node B. The reset sub-circuit 102 is configured to reset an electric potential $V_B$ of the second terminal T2 of the storage capacitor $C_{st}$.

In some embodiments, the pixel circuit 10 farther includes a compensation sub-circuit 103. In one embodiment, as shown in FIG. 1, the compensation sub-circuit 103 includes a third transistor M3. A gate of the third transistor M3 is coupled to a second gate signal terminal G(n). A first electrode of the third transistor M3 is coupled to the second terminal T2 of the storage capacitor $C_{st}$, at the second node B. A second electrode of the third transistor M3 is coupled to a first electrode of a driving transistor DTFT. The compensation sub-circuit 103 is configured to compensate a threshold voltage Vth of the driving transistor DTFT.

In some embodiments, the pixel circuit 10 further includes a input sub-circuit 104. In one embodiment, as shown in FIG. 1, the input sub-circuit 104 includes a fourth transistor M4. A gate of the fourth transistor M4 is coupled to a second gate signal terminal G(n). A first electrode of the fourth transistor M4 is coupled to the data voltage terminal Data(n). A second electrode of the fourth transistor M4 is coupled to a second electrode of the driving transistor DTFT at the third node C. The input sub-circuit 104 is configured to apply a data voltage Vdata to the second electrode of the driving transistor DTFT under a control of a second gate signal in the second gate signal terminal G(n).

In some embodiments, as shown in FIG. 1, the light-emitting control sub-circuit 105 includes a fifth transistor M5 and a sixth transistor M6. A gate of the fifth transistor M5 and a gate of the sixth transistor M6 are coupled to the light-emitting control terminal EM(n) respectively. A first electrode of the fifth transistor M5 and a first electrode of the sixth transistor M6 are coupled to the first voltage terminal VDD respectively. A second electrode of the fifth transistor M5 is coupled to the first terminal T1 of the storage capacitor $C_{st}$ at the first node A. A second electrode of the sixth transistor M6 is coupled to the second electrode of the fourth transistor M4 and the second electrode of the driving transistor DTFT at the third node C.

In some embodiments, the pixel circuit 10 further includes a driving transistor DTFT. In one embodiment, as shown in FIG. 1, a gate of the driving transistor STFT is coupled to the second terminal T2 of the storage capacitor $C_{st}$ at the second node B. A first electrode of the driving transistor DTFT is coupled to a first electrode of a switch transistor STFT and the second electrode of the third transistor M3. A second electrode of the driving transistor DTFT is coupled to the second electrode of the fourth transistor M4 and the second electrode of the sixth transistor M6 at the third node C. The driving transistor DTFT is configured to drive a light-emitting element 20 for emitting light.

In some embodiments, the pixel circuit 10 further includes a switch transistor STFT. In one embodiment, as shown in FIG. 1, a gate of the switch transistor STFT is coupled to the light-emitting control terminal EM(n). The first electrode of the switch transistor STFT is coupled to the first electrode of the driving transistor DTFT. A second electrode of the switch transistor STFT is coupled to the light-emitting element 20. The light-emitting element 20 may include, but are not limited to, organic light-emitting diodes (OLEDs), quantum light-emitting diodes (QLEDs), or Micro-LEDs, or a combination thereof. One terminal of the light-emitting element 20 is coupled to the switch transistor STFT, while the other terminal of the light-emitting element 20 is coupled to a second voltage terminal VSS. The switch transistor STFT is configured to control the connection between the driving transistor DTFT and the light-emitting element 20.

In some embodiments, the first transistor is one of P-type transistor and N-type transistor, and the fifth transistor and the sixth transistor are the other one of P-type transistor and N-type transistor. For example, the first transistor and the driving transistor are P-type transistors. The second transistor, the third transistor, the fourth transistor, the fifth transistor, the sixth transistor and the switch transistor are N-type transistors. In another example, the first transistor and the driving transistor are N-type transistors. The second transistor, the third transistor, the fourth transistor, the filth transistor, the sixth transistor and the switch transistor are P-type transistors.

In some embodiment, as shown in FIG. 1, the first transistor M1 and the driving transistor DTFT are transistors of the same type, for example, P-type transistors. The second transistor M2, the third transistor M3, the fourth transistor M4, the fifth transistor M5, the sixth transistor M6 and the switch transistor STFT are transistors of the same type, but different from the first transistor M1 and the driving transistor DTFT, for example, N-type transistors.

Here, the first electrode of the above-mentioned transistor may be the drain and the second electrode may be the source. Alternatively, the first electrode may be the source, and the second electrode may be the drain, which are not limited in the embodiments of the present disclosure.

Further, based on the various electrically conductive manner of the transistors, the transistors in the above pixel circuit can be classified as enhancement transistors or depletion transistors. The embodiment of the present disclosure is not limited to these.

Second, in the embodiments of the present disclosure, that a high-level voltage is inputted to the first voltage terminal VDD and a low-level voltage is inputted into the second voltage terminal VSS is taken as an example. The second voltage terminal VSS can also be grounded. The high and low values only indicate the relative magnitude relationship between the input voltages.

Third, in the embodiments of the present disclosure, the second gate signal terminal G(n) is associated to a n-staged scan line, and the first gate, signal terminal G(n-1) is associated to a (n-1)-staged scan line previous to the n-staged scan line.

Figure 2:
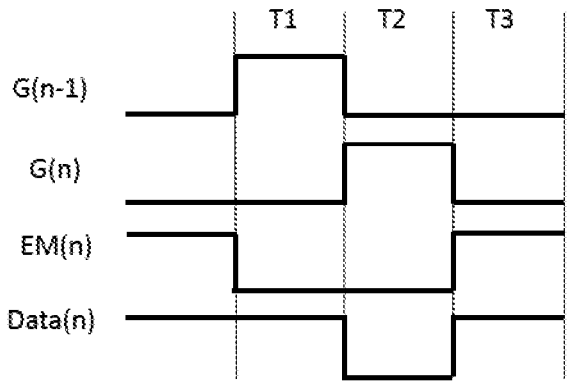
FIG. 2 is a schematic waveform diagram during operation of the pixel circuit according to the embodiment as shown in FIG. 1.

FIG. 2 is a schematic waveform diagram during operation of the pixel circuit according to the embodiment as shown in FIG. 1. In some embodiments, operation of the pixel circuit 10 having the above-described configuration according to FIG. 1 will be described with reference to FIGS. 3 to 5. The operation may be divided into three periods.

In some embodiments, the present disclosure provides a driving method for a pixel circuit described herein. The driving method includes storing an initial voltage to a first terminal of the storage capacitor; resetting an electric potential of a second terminal of the storage capacitor to be equal to a reference voltage; inputting a data voltage to a second electrode of the driving transistor; compensating the electric potential of the second terminal of the storage capacitor by charging the storage capacitor until the electric potential of the second terminal of the storage capacitor being equal to a sum of the data voltage and a threshold voltage of the driving transistor; and controlling a light-emitting element to emit light.

In some embodiments, the step of storing the initial voltage to the first terminal of the storage capacitor includes turning on the first transistor so that an electric potential of the first terminal of the storage capacitor is equal to the initial voltage.

In some embodiments, the step of resetting the electric potential of the second terminal of the storage capacitor to be equal to a reference voltage includes turning on the second transistor so that the electric potential of the second terminal of the storage capacitor is equal to the reference voltage.

In some embodiments, the step of inputting the data voltage to the second electrode of the driving transistor and compensating the electric potential of the second terminal of the storage capacitor include turning on the first transistor, the third transistor, the fourth transistor and the driving transistor, so that the electric potential of the second terminal of the storage capacitor is equal to a sum of the data voltage and a threshold voltage of the driving transistor.

In some embodiments, the step of controlling the light-emitting element to emit light includes turning on the fifth transistor, the sixth transistor, the driving transistor and the switch transistor, so that the electric potential of the first terminal of the storage capacitor is equal to a first voltage, the electric potential of the second terminal of the storage capacitor is equal to a sum of the data voltage, a threshold voltage of the driving transistor, and a result of the first voltage minus the initial voltage.

Figure 3:
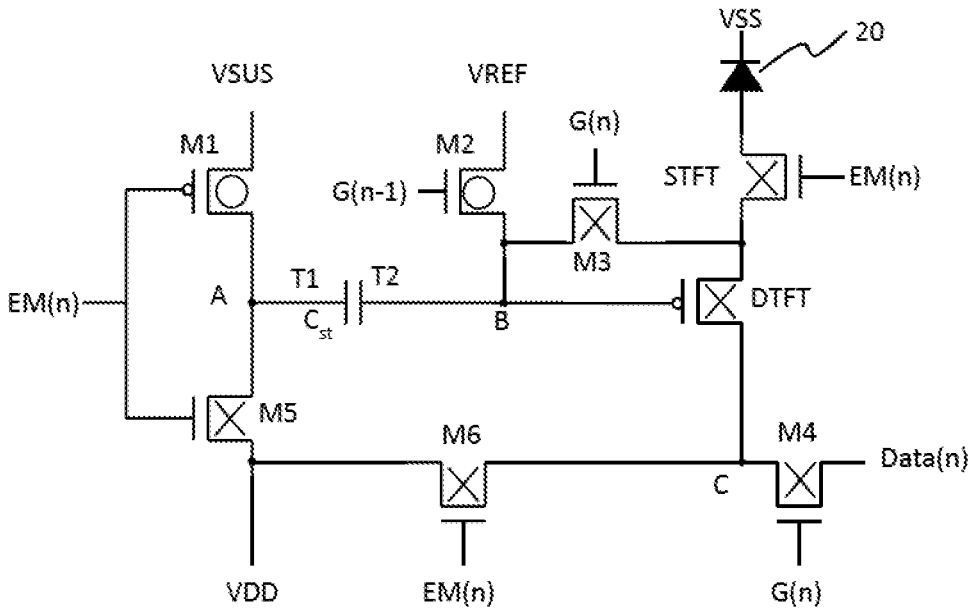
FIG. 3 is a schematic equivalent circuit diagram during operation of the pixel circuit according to the embodiment as shown in FIG. 1 in a first period.

FIG. 3 is a schematic equivalent circuit diagram during operation of the pixel circuit according to the embodiment as shown in FIG. 1 in the first period. The first period may be an initialization and reset period.

During the first period, the first gate signal terminal G(n-1) provides a high level voltage: the second gate signal terminal G(n) provides a low level voltage; the light-emitting control terminal EM(n) provides a low level voltage; and the data voltage terminal Data(n) provides a high level voltage. It should be noted that the data voltage at a low level may be an ineffective signal and the data voltage at a high level may be an effective signal in some embodiments of the present disclosure. Gate signals provided by the first gate signal terminal and the second gate signal terminal at a low level may be an ineffective signal and the gate signals at a high level may be an effective signal in some embodiments of the present disclosure which depend on the type of transistor.

Thus, during the first period, the first transistor M1 and the second transistor M2 are turned on: the third transistor M3, the fourth transistor M4, the fifth transistor M5, the sixth transistor M6, the driving transistor DTFT and the switch transistor STFT are turned off. The initial voltage terminal VSUS is applying the initial voltage Vsus to the first transistor M1, and the initial voltage is stored in the first terminal T1 of the storage capacitor $C_{st}$ at the first node A. The electric potential $V_A$ at the first node A is equal to the initial voltage Vsus. The reference voltage terminal VREF is applying the reference voltage Ref to the second transistor M2, and the electric potential $V_B$ at the second node B is equal to the reference voltage Ref. The reference voltage Ref has an electrical potential that is an ineffective signal to the gate of the driving transistor DTFT.

Figure 4:
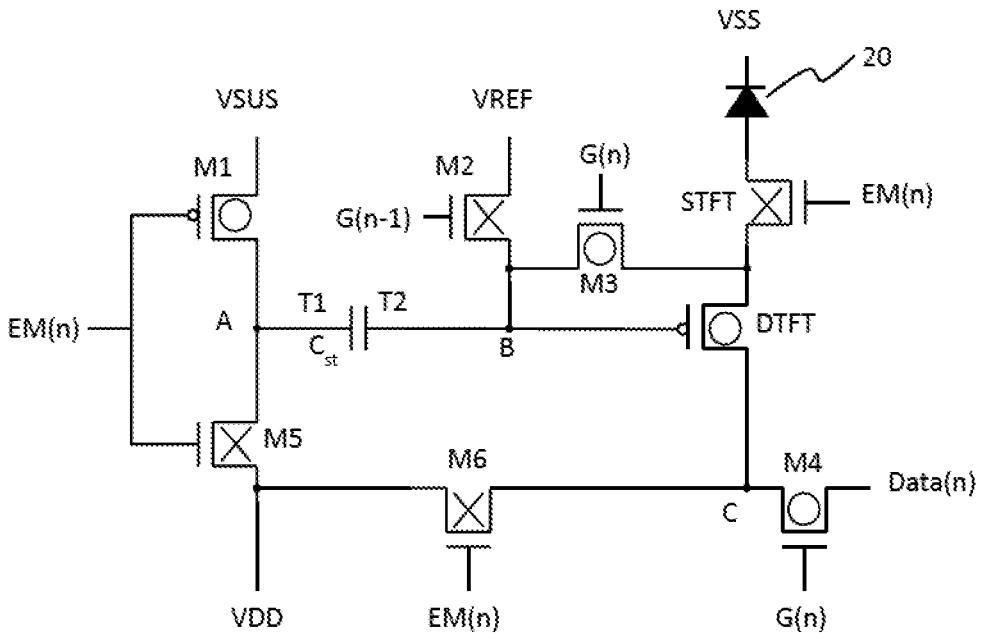
FIG. 4 is a schematic equivalent circuit diagram during operation of the pixel circuit according to the embodiment as shown in FIG. 1 in a second period.

FIG. 4 is a schematic equivalent circuit diagram during operation of the pixel circuit according to the embodiment as shown in FIG. 1 in the second period. The second period may be an input and compensation period.

During the second period, the first gate signal terminal G(n-1) provides a low level Voltage; the second gate signal terminal G(n) provides a high level voltage; the light-emitting control terminal EM(n) provides a low level voltage; and the data voltage terminal Data(n) provides a low level voltage.

Thus, during the second period, the first transistor M1, the third transistor M3, the fourth transistor M4, and the driving transistor DTFT are turned on; the second transistor M2, the fifth transistor M5, the sixth transistor M6 and the switch transistor STFT are turned off. The data voltage terminal Data(n) is applying the data voltage Vdata to the fourth transistor M4, and charging the storage capacitor $C_{st}$ through the third transistor M3, the fourth transistor M4, and the driving transistor DTFT. The charging will not stop until the electric potential $V_B$ at the second node B is equal to a sum of the data voltage Vdata and a threshold voltage Vth of the driving transistor DTFT. Then, the driving transistor DTFT is cutoff. The electric potential $V_A$ at the first node A remains equal to the initial voltage Vsus. The electric potential $V_C$ at the third node C is equal to the data voltage Vdata.

Figure 5:
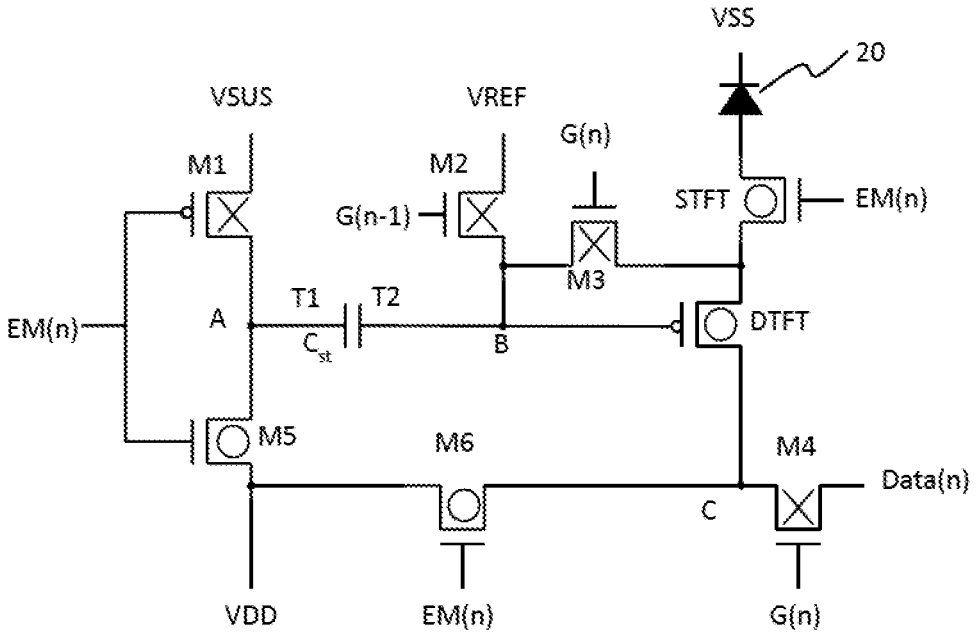
FIG. 5 is a schematic equivalent circuit diagram during operation of the pixel circuit according to the embodiment as shown in FIG. 1 in a third period.

FIG. 5 is a schematic equivalent circuit diagram during operation of the pixel circuit according to the embodiment as shown in FIG. 1 in the third period. The third period may be a light-emitting period.

During the third period, the first gate signal terminal G(n-1) provides a low level voltage: the second gate signal terminal G(n) provides a low level voltage: the light-emitting control terminal EM(n) provides a high level voltage; and the data voltage terminal Data(n) provides a high level voltage.

Thus, during the third period, the fifth transistor M5, the sixth transistor M6, the switch transistor STFT and the driving transistor DTFT are turned on; the first transistor M, the second transistor M2, the third transistor M3, and the fourth transistor M4 are turned off. The first voltage terminal VDD is applying the first voltage Vdd to the storage capacitor $Ca_{st}$ at the first node A. The electric potential $V_A$ at the first node A is changed to be equal to Vdd, and the variation of the electric potential $V_A$ is equal to Vdd-Vsus. Because of the coupling effect of the storage capacitor $C_{st}$ the electric potential $V_B$ at the second node B is coupled to Vdata+Vth+(Vdd−Vsus). The electric potential $V_B$ at the second node B is configured to turn on the driving transistor DTFT during the third period. The electric potential $V_C$ at the third node is changed to the first voltage Vdd because of the connection of the sixth transistor M6.

In some embodiments, the driving transistor DTFT, the switching transistor STFT and the light-emitting element 20 are coupled in series. Accordingly, the current $I_{OLED}$ in the light-emitting element 20 can be calculated by the following equation:

$$I_{OLED}=K(\text{Vgs}-\text{Vth})^2$$

Where K represents a constant index related to the light-emitting element, Vgs represents the voltage difference between the gate and the source of the driving transistor DTFT, and the Vth represents the threshold voltage of the driving transistor DTFT. The source of the driving transistor DTFT is the second electrode of the driving transistor DTFT. Accordingly, the Vgs can be calculated by the following equation:

$$\text{Vgs}=V_B-V_C=(\text{Vdata}+\text{Vth}+\text{Vdd}-\text{Vsus})-\text{Vdd}$$

$$I_{OLED}\propto(\text{Vgs}-\text{Vth})^2=(\text{Vdata}-\text{Vsus})^2$$

In this way, the current $I_{OLED}$ in the light-emitting element 20 is directly proportional to the square of the difference of the data voltage Vdd and the initial voltage Vsus, and has no relationship with the first voltage Vdd. The first voltage Vdd drops during the light-emitting period, while the current $I_{OLED}$ keeps constant. Thus, the influence of the Vdd drop has been reduced or eliminated, and the display uniformity of the display apparatus has been improved.

The principle and the embodiment of the present disclosure are set forth in the specification. The description of the embodiments of the present disclosure is only used to help understand the method of the present disclosure and the core idea thereof. Meanwhile, for a person of ordinary skill in the art, the disclosure relates to the scope of the disclosure, and the technical scheme is not limited to the specific combination of the technical features, and also should covered other technical schemes which are formed by combining the technical features or the equivalent features of the technical features without departing from the inventive concept. For example, technical scheme may be obtained by replacing the features described above as disclosed in this disclosure but not limited to) with similar features.

Reference numbers in the figures;

pixel circuit 10; initialization sub-circuit 101; reset sub-circuit 102; compensation sub-circuit 103; input sub-circuit 104; light-emitting control sub-circuit 105; storage capacitor $C_{st}$; driving transistor DTFT; switch transistor STFT; light-emitting element 20; initial voltage terminal VSUS; reference voltage terminal VREF; first voltage terminal VDD; second voltage terminal VSS; light-emitting control terminal EM(n); data voltage terminal Data(n); first gate signal terminal G(n-1); second gate signal terminal G(n); first node A; second node B; third node C; first transistor M1; second transistor M2; third transistor M3; fourth transistor M4; fifth transistor M5; sixth transistor M6.

What is claimed is:

1. A pixel circuit, comprising:

a storage capacitor comprising a first terminal and a second terminal;

an initialization sub-circuit comprising an initial voltage terminal, the initialization sub-circuit being coupled to the first terminal of the storage capacitor and a light-emitting control terminal; and a light-emitting control sub-circuit comprising a first voltage terminal, the light-emitting control sub-circuit being coupled to the first terminal of the storage capacitor and the light-emitting control terminal, wherein the initialization sub-circuit is configured to store an initial voltage of the initial voltage terminal in the first terminal of the storage capacitor under a control of a light-emitting control signal of the light-emitting control terminal;

the light-emitting control sub-circuit is configured to apply a first voltage of the first voltage terminal to the first terminal of the storage capacitor;

the first voltage terminal and the initial voltage terminal are separated terminals;

the initialization sub-circuit comprises a first transistor, a gate of the first transistor is coupled to the light-emitting control terminal, a first electrode of the first transistor is coupled to the initial voltage terminal and a second electrode of the first transistor is coupled to the first terminal of the storage capacitor;

the light-emitting control sub-circuit comprises a fifth transistor and a sixth transistor;

a gate of the fifth transistor and a gate of the sixth transistor are respectively coupled to the light-emitting control terminal;

a first electrode of the fifth transistor and a first electrode of the sixth transistor are respectively coupled to the first voltage terminal; and a second electrode of the fifth transistor is coupled to the first terminal of the storage capacitor.

2. The pixel circuit according to claim 1, further comprising:

a reset sub-circuit comprising a second transistor, a reference voltage terminal and a first gate signal terminal, wherein:

a gate of the second transistor is coupled to the first gate signal terminal;

a first electrode of the second transistor is coupled to the reference voltage terminal;

a second electrode of the second transistor is coupled to the second terminal of the storage capacitor; and the reset sub-circuit is configured to reset an electric potential of the second terminal of the storage capacitor.

3. The pixel circuit according to claim 2, further comprising a driving transistor, wherein: a gate of the driving transistor is coupled to the second terminal of the storage capacitor;

a second electrode of the driving transistor is coupled to a second electrode of the sixth transistor; and the driving transistor is configured to drive a light-emitting element.

4. The pixel circuit according to claim 3, further comprising:

an input sub-circuit comprising a fourth transistor, a second gate signal terminal and a data voltage terminal, wherein:

a gate of the fourth transistor is coupled to the second gate signal terminal;

a first electrode of the fourth transistor is coupled to the data voltage terminal;

a second electrode of the fourth transistor is coupled to the second electrode of the driving transistor; and the input sub-circuit is configured to apply a data voltage to the second electrode of the driving transistor under a control of a second gate signal in the second gate signal terminal.

5. The pixel circuit according to claim 4, further comprising:

a compensation sub-circuit comprising a third transistor, wherein:

a gate of the third transistor is coupled to the second gate signal terminal;

a first electrode of the third transistor is coupled to the second terminal of the storage capacitor;

a second electrode of the third transistor is coupled to a first electrode of the driving transistor; and the compensation sub-circuit is configured to compensate a threshold voltage of the driving transistor.

6. The pixel circuit according to claim 5, further comprising:

a switch transistor, wherein:

a gate of the switch transistor is coupled to the light-emitting control terminal;

a first electrode of the switch transistor is coupled to the first electrode of the driving transistor;

a second electrode of the switch transistor is coupled to a first terminal of the light-emitting element; and the switch transistor is configured to control the connection between the driving transistor and the light-emitting element.

7. The pixel circuit according to claim 6, wherein:

the first transistor and the driving transistor are P-type transistors, and the second transistor, the third transistor, the fourth transistor, the fifth transistor, the sixth transistor and the switch transistor are N-type transistors.

8. The pixel circuit according to claim 6, wherein:

the first transistor and the driving transistor are N-type transistors, and the second transistor, the third transistor, the fourth transistor, the fifth transistor, the sixth transistor and the switch transistor are P-type transistors.

9. The pixel circuit according to claim 4, wherein:

the light-emitting element is an organic light-emitting diode, and a second terminal of the light-emitting element is coupled to a second voltage terminal.

10. The pixel circuit according to claim 1, wherein:

the first transistor is one of P-type transistor and N-type transistor, and the fifth transistor and the sixth transistor are the other one of P-type transistor and N-type transistor.

11. A display apparatus, comprising a plurality of sub-pixels, wherein each of the plurality of sub-pixels comprises the pixel circuit of claim 1, and a light-emitting element.

12. A driving method for a pixel circuit coupled to a light-emitting element, the pixel circuit comprises a storage capacitor, an initialization sub-circuit, a light-emitting control sub-circuit, a reset sub-circuit, a driving transistor, a switch transistor, an input sub-circuit and a compensation sub-circuit, wherein the driving method comprises:

storing an initial voltage to a first terminal of the storage capacitor;

resetting an electric potential of a second terminal of the storage capacitor to be equal to a reference voltage;

inputting a data voltage to a second electrode of the driving transistor;

compensating the electric potential of the second terminal of the storage capacitor, by charging the storage capacitor until the electric potential of the second terminal of the storage capacitor being equal to a sum of the data voltage and a threshold voltage of the driving transistor; and controlling the light-emitting element to emit light;

wherein the initialization sub-circuit comprises a first transistor and an initial voltage terminal, the initialization sub-circuit being coupled to the first terminal of the storage capacitor and a light-emitting control terminal, a gate of the first transistor being coupled to the light-emitting control terminal, a first electrode of the first transistor being coupled to the initial voltage terminal, and a second electrode of the first transistor being coupled to the first terminal of the storage capacitor, and wherein the storing the initial voltage to the first terminal of the storage capacitor comprises: turning on the first transistor so that an electric potential of the first terminal of the storage capacitor is equal to the initial voltage.

13. The driving method according to claim 12, wherein the reset sub-circuit comprises a second transistor, a reference voltage terminal and a first gate signal terminal, a gate of the second transistor being coupled to the first gate signal terminal, a first electrode of the second transistor being coupled to the reference voltage terminal, and a second electrode of the second transistor being coupled to the second terminal of the storage capacitor, wherein the resetting the electric potential of the second terminal of the storage capacitor to be equal to a reference voltage comprises:

turning on the second transistor so that the electric potential of the second terminal of the storage capacitor is equal to the reference voltage.

14. The driving method according to claim 13, wherein the input sub-circuit comprises a fourth transistor, a second gate signal terminal and a data voltage terminal, a gate of the fourth transistor being coupled to the second gate signal terminal, a first electrode of the fourth transistor being coupled to the data voltage terminal, a second electrode of the fourth transistor being coupled to the second electrode of the driving transistor, and the compensation sub-circuit comprises a third transistor coupled to the second gate signal terminal, the second terminal of the storage capacitor, and a first electrode of the driving transistor, a gate of the third transistor being coupled to the second gate signal terminal, a first electrode of the third transistor being coupled to the second terminal of the storage capacitor, a second electrode of the third transistor being coupled to a first electrode of the driving transistor, wherein the inputting the data voltage to the second electrode of the driving transistor and compensating the electric potential of the second terminal of the storage capacitor comprise:

turning on the first transistor, the third transistor, the fourth transistor and the driving transistor, so that the electric potential of the second terminal of the storage capacitor is equal to a sum of the data voltage and the threshold voltage of the driving transistor.

15. The driving method according to claim 14, wherein the light-emitting control sub-circuit comprises a fifth transistor and a sixth transistor, both of a gate of the fifth transistor and a gate of the sixth transistor being coupled to a light-emitting control terminal, both of a first electrode of the fifth transistor and a first electrode of the sixth transistor being coupled to a first voltage terminal, a second electrode of the fifth transistor being coupled to the first terminal of the storage capacitor, and a second electrode of the sixth transistor being coupled to the second electrode of the driving transistor and the second electrode of the fourth transistor;

the switch transistor comprises a gate coupled to the light-emitting control terminal, a first electrode coupled to the first electrode of the driving transistor, and a second electrode coupled to the light-emitting element, wherein the controlling the light-emitting element to emit light comprises:

turning on the fifth transistor, the sixth transistor, the driving transistor and the switch transistor, so that the electric potential of the first terminal of the storage capacitor is equal to a first voltage, the electric potential of the second terminal of the storage capacitor is equal to a sum of the data voltage, a threshold voltage of the driving transistor and a result of the first voltage minus the initial voltage.

* * * * *